US012213528B2

(12) United States Patent
Mironov et al.

(10) Patent No.: US 12,213,528 B2
(45) Date of Patent: Feb. 4, 2025

(54) AEROSOL-GENERATING SYSTEMS AND METHODS FOR GUIDING AN AIRFLOW INSIDE AN ELECTRICALLY HEATED AEROSOL-GENERATING SYSTEM

(71) Applicant: Philip Morris Products S.A., Neuchatel (CH)

(72) Inventors: Oleg Mironov, Neuchatel (CH); Ihar Nikolaevich Zinovik, Peseux (CH); Keethan Dasnavis Fernando, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 18/339,945

(22) Filed: Jun. 22, 2023

(65) Prior Publication Data

US 2023/0329344 A1 Oct. 19, 2023

Related U.S. Application Data

(63) Continuation of application No. 17/335,354, filed on Jun. 1, 2021, now Pat. No. 11,723,409, which is a (Continued)

(30) Foreign Application Priority Data

Dec. 15, 2014 (EP) ..... 14197849
Jul. 13, 2015 (EP) ..... 15176545

(51) Int. Cl.
*A24F 40/48* (2020.01)
*A24F 40/10* (2020.01)
(Continued)

(52) U.S. Cl.
CPC ..... *A24F 40/46* (2020.01); *A24F 40/48* (2020.01); *A24F 40/485* (2020.01); *F22B 1/284* (2013.01); *A24F 40/10* (2020.01)

(58) Field of Classification Search
CPC ..... A24F 40/10; A24F 40/46; A24F 40/48; A24F 40/485; F22B 1/284
See application file for complete search history.

(56) References Cited

U.S. PATENT DOCUMENTS 9,439,455 B2 * 9/2016 Alarcon ..... A24F 40/51
9,603,389 B2 3/2017 Chen
(Continued)

FOREIGN PATENT DOCUMENTS

CN 102573968 A 7/2012
CN 102655773 A 9/2012
(Continued)

OTHER PUBLICATIONS

International Search Report and Written Opinion issued Apr. 12, 2016 in PCT/EP2015/079623, filed Dec. 14, 2015.
(Continued)

*Primary Examiner* — Abdullah A Riyami
*Assistant Examiner* — Thang H Nguyen
(74) *Attorney, Agent, or Firm* — Oblon, McClelland, Maier & Neustadt, L.L.P.

(57) ABSTRACT

An aerosol-generating system comprises a liquid storage portion comprising a container holding a liquid aerosol-forming substrate and defining an opening, and a heater assembly which extends across the opening along a transverse plane. The heater assembly comprises at least one electrically operated heating element, and a first channel defines a first flow route which brings ambient air into impingement against the heater assembly. In an embodiment a portion of the first channel is arranged orthogonally to the
(Continued)

transverse plane such that the at least a portion of the first channel directs ambient air from outside the system to impinge perpendicularly onto a surface portion of the heating element before conveying the ambient air to a downstream end.

20 Claims, 4 Drawing Sheets

Related U.S. Application Data continuation of application No. 16/877,210, filed on May 18, 2020, now Pat. No. 11,051,552, which is a continuation of application No. 15/536,399, filed as application No. PCT/EP2015/079623 on Dec. 14, 2015, now Pat. No. 10,750,784.

(51) Int. Cl.

| | |
|---|---|
| ***A24F 40/46*** | (2020.01) |
| ***A24F 40/485*** | (2020.01) |
| ***F22B 1/28*** | (2006.01) |

(56) References Cited

U.S. PATENT DOCUMENTS

| | | | | |
|---|---|---|---|---|
| 9,814,269 | B2 * | 11/2017 | Li | H05B 3/44 |
| 9,820,512 | B2 * | 11/2017 | Mironov | A24F 40/42 |
| 10,524,504 | B2 | 1/2020 | Li et al. | |
| 11,234,464 | B2 | 2/2022 | Qiu | |
| 2008/0092912 | A1 * | 4/2008 | Robinson | A24D 1/002 131/200 |
| 2009/0272379 | A1 * | 11/2009 | Thorens | A24F 40/485 219/535 |
| 2011/0094523 | A1 * | 4/2011 | Thorens | H05B 3/0014 131/194 |
| 2011/0265806 | A1 * | 11/2011 | Alarcon | A24F 40/485 131/273 |
| 2012/0199663 | A1 | 8/2012 | Qiu | |
| 2014/0182610 | A1 * | 7/2014 | Liu | A24F 40/42 131/329 |
| 2014/0305454 | A1 * | 10/2014 | Rinker | A24F 40/46 131/329 |
| 2014/0318559 | A1 * | 10/2014 | Thorens | A24F 40/44 131/329 |
| 2014/0334802 | A1 * | 11/2014 | Dubief | A61L 9/03 392/390 |
| 2014/0334803 | A1 | 11/2014 | Li et al. | |
| 2015/0020832 | A1 * | 1/2015 | Greim | A24F 40/65 131/329 |
| 2015/0090279 | A1 | 4/2015 | Chen | |
| 2015/0136156 | A1 | 5/2015 | Chen | |
| 2015/0327596 | A1 * | 11/2015 | Alarcon | H04L 67/535 131/328 |
| 2017/0006916 | A1 | 1/2017 | Liu | |
| 2017/0035109 | A1 * | 2/2017 | Liu | A24F 40/42 |
| 2017/0035113 | A1 * | 2/2017 | Thorens | H05B 3/34 |
| 2018/0242639 | A1 * | 8/2018 | Borkovec | A24F 40/42 |

FOREIGN PATENT DOCUMENTS

| | | | |
|---|---|---|---|
| CN | 103237468 | A | 8/2013 |
| CN | 103584287 | A | 2/2014 |
| CN | 103 783 674 | A | 5/2014 |
| CN | 103844359 | A | 6/2014 |
| CN | 103932401 | A | 7/2014 |
| CN | 103974639 | A | 8/2014 |
| CN | 203748680 | U | 8/2014 |
| CN | 203952443 | U | 11/2014 |
| CN | 203986095 | U | 12/2014 |
| CN | 203986096 | U | 12/2014 |
| CN | 204070542 | U | 1/2015 |
| CN | 204317492 | U | 5/2015 |
| CN | 108926037 | B | 1/2022 |
| EP | 1 699 071 | A1 | 9/2006 |
| EP | 2 319 334 | A1 | 5/2011 |
| EP | 2 574 247 | A1 | 4/2013 |
| EP | 2 989 912 | B1 | 9/2014 |
| EP | 2 798 968 | A4 | 9/2015 |
| EP | 2 965 642 | A1 | 1/2016 |
| EP | 3 020 292 | A1 | 5/2016 |
| JP | 2011-103476 | A | 5/2011 |
| JP | 2013-524835 | A | 6/2013 |
| JP | 2021-27267 | | 2/2021 |
| UA | a 2015 08996 | | 1/2016 |
| WO | WO 97/48293 | A1 | 12/1997 |
| WO | 2011/137453 | A2 | 11/2011 |
| WO | WO 2013/045582 | A2 | 4/2013 |
| WO | 2013/083635 | A | 6/2013 |
| WO | 2013/159245 | A1 | 10/2013 |
| WO | WO 2013/152873 | A1 | 10/2013 |
| WO | WO 2014/079024 | A1 | 5/2014 |
| WO | WO 2014/101114 | A1 | 7/2014 |
| WO | WO 2014/140273 | A2 | 9/2014 |
| WO | 2015/066127 | A1 | 5/2015 |
| WO | WO-2015079197 | A1 * | 6/2015 ..... A24F 40/05 |
| WO | 2015/117700 | A1 | 8/2015 |
| WO | 2017/141358 | A1 | 8/2017 |

OTHER PUBLICATIONS

Office Action issued Aug. 27, 2018 in Japanese Patent Application No. 2017-530651, 19 pages (with English translation).

Office Action issued Mar. 16, 2018 in Canadian Patent Application No. 2,963,727.

Office Action issued Jun. 23, 2020 in U.S. Appl. No. 16/877,210 (14 pages}.

Provisional Conclusion of Substantive Examination mailed Feb. 21, 2020 in counterpart Ukrainian Patent Application No. a 2017 04838 (English translation) (4 pages).

Extended European Search Report issued Mar. 2, 2021 in corresponding European Patent Application No. 20208979.3, 8 pages.

European Notice of Opposition issued Aug. 31, 2021 in European Patent Application No. 15817141.3, 40 pages.

European Notice of Opposition issued Aug. 30, 2021 in European Patent Application No. 15817141.3, 46 pages.

Vietnamese Office Action issued Feb. 25, 2020, in Vietnamese Patent Application No. 1-2017-01917, 29 pages.

Notice of Grounds for Rejection mailed on Jan. 5, 2023 in Japanese Patent Application No. 2021-027267 filed on Feb. 24, 2021, with English Translation, total 15 pages.

Chinese Office Action issued Aug. 25, 2023 in Chinese Patent Application No. 2021101566295 (with English Translation of Office Action and Search Report), 8 pages.

Combined Chinese Office Action and Search Report issued Nov. 6, 2023 in Chinese Patent Application No. 202110166514.4 (with English Translation), 11 pages.

Combined Chinese Office Action and Search Report issued Oct. 26, 2023 in Chinese Patent Application No. 202110157493.X (with English Translation), 12 pages.

European Notice of Opposition issued Jan. 18, 2024 in European Patent Application No. EP20208979.3, 7 pages.

Office Action dated Aug. 26, 2024, issued in corresponding Japanese patent application No. 2023-130020 (with English translation).

* cited by examiner

AEROSOL-GENERATING SYSTEMS AND METHODS FOR GUIDING AN AIRFLOW INSIDE AN ELECTRICALLY HEATED AEROSOL-GENERATING SYSTEM

CROSS-REFERENCE TO RELATED APPLICATIONS

This application is a continuation of and claims benefit under 35 U.S.C. § 120 to U.S. application Ser. No. 17/335,354, filed Jun. 1, 2021, which is based upon and claims benefit under 35 U.S.C. § 120 to U.S. application Ser. No. 16/877,210, filed May 18, 2020 (now U.S. Pat. No. 11,051,552), which is based upon and claims benefit under 35 U.S.C. § 120 to U.S. application Ser. No. 15/536,399, filed Jun. 15, 2017 (now U.S. Pat. No. 10,750,784), which is a U.S. National Stage application of PCT/EP2015/079623, filed on Dec. 14, 2015, and claims the benefit of priority under 35 U.S.C. § 119 from EP 14197849.4 and EP 15176545.0, filed on Dec. 15, 2014 and Jul. 13, 2015, respectively, the entire contents of each of which are incorporated herein by reference.

BACKGROUND

The invention relates to electrically heated aerosol-generating systems, such as electrically heated smoking systems, and a method for guiding an airflow inside such systems.

Some aerosol-generating systems may comprise a battery and control electronics, a cartridge comprising a supply of aerosol forming substrate and an electrically operated vaporizer. A substance is vaporized from the aerosol forming substrate, for example by a heater. An airflow is made to pass the heater to entrain the vaporized liquid and guide it through a mouthpiece to a mouth end of the mouthpiece, while a user is inhaling (e.g. "puffing") at the mouth end.

It would be desirable to manage the flow air so that as much of the liquid vaporized by the heater as possible is carried away from the heating zone for inhalation during each puff. It would be further desirable to manage the flow so as to minimize the formation of droplets outside a desired inhalable range.

BRIEF SUMMARY

According to a first aspect, there is provided an electrically heated smoking system for generating aerosol. The heated smoking system utilizes a heater positioned relative to an airflow system having a downstream end and one or more channels for drawing ambient air. Each of the one or more channels defines a respective flow route. A first flow route defined by a first channel directs air from outside the system so that it impinges against one or more electrical heating elements of the heater before conveying the ambient air to the downstream end. The air carried along each first flow route may be directed at the heater as ambient air without pre-heating, or it may be subjected to a pre-heating step before being brought into impingement against and along the heater.

In some embodiments, the air is brought by the first flow route into initial impingement along a path that is substantially orthogonal to a plane in which the electrical heating element(s) of the heater are arranged. Such an arrangement is advantageous because a perpendicular angle of impingement directed at the geometric center of a heater has been found to promote efficient entrainment of vapor. Where multiple channels are used, the respective flows may be combined prior to or somewhere along a common orthogonal path. Alternatively, the one or more flows may be brought into impingement with the heater assembly at any angle such that the flow impinges against and along a common plane which passes through the one or more heating element(s).

Vapor in the zone of the heater is collected by air flowing in the one or more channels and is transported to the downstream end of the airflow system. As the vapor condenses within the flowing air, droplets are formed to thereby generate an aerosol. It has been found that an ambient airflow impinging upon the heating element at 90 degree angle efficiently and effectively entrains the vapor so that it can be guided to a downstream "mouth" end of the system. The greater the ambient airflow striking the heating element, the greater the efficiency of entrainment and evacuation of vapor. In particular, if the ambient air impinges onto the surface of a heating assembly at an angle orthogonal to its geometric center, a homogeneous airflow over the heating element may be provided in a radially outward direction.

The volume of the ambient air passing through the first and any additional channels and brought into perpendicular impingement against the heating element(s) may be varied and adapted to, for example, the kind of heating element applied or the amount of vaporized liquid available. For example, the volume of ambient air brought into impingement with the heating element may be adapted to a total area, which is effectively heated by the heating element.

In embodiments, the heated, vapor-containing air leaving the zone of the heater is passed along a cooling zone in cross proximity to where the aerosol forming substrate is stored within the cartridge. Because the surface of the cartridge in this zone has a lower temperature than the vapor-containing air, such proximity has a substantial cooling effect. This effect is especially pronounced when the air is passed through thin channels dimensioned and arranged to maximize flow interaction within the surface of the cartridge. The rapid cooling which results causes an oversaturation of the air with the vaporized liquid which, in turn, promotes the formation of smaller aerosol droplets. In some embodiments, it is preferred to maintain the droplet size during vapor condensation to an inhalable range of from 0.5 to 1 microns.

In some embodiments, a sharp bend (e.g., on the order of 90 degree) in the flow of aerosol around the portion of the cartridge housing the liquid substrate performs a complementary droplet filtering function, wherein droplets in excess of the inhalable range condense in the corner(s) of the flow path such that they are not delivered to the downstream end.

As a general rule, whenever the term 'about' is used in connection with a particular value throughout this application this is to be understood such that the value following the term 'about' does not have to be exactly the particular value due to technical considerations. However, the term 'about' used in connection with a particular value is always to be understood to include and also to explicitly disclose the particular value following the term 'about'.

With respect to the orientation and position of the heater relative to an opening in a container containing an aerosol-generating liquid, the term "across" is intended to refer to an arrangement in which one or more heating elements through which a common plane passes (e.g., a plane transverse to the container opening") are positioned over or across at least part of the opening. In some embodiments, for example, the heater may completely cover the container opening while in other embodiments, the heater may only partially cover the container opening. In yet other embodiments, the heater may be positioned within the opening such that it extends across the entire opening on all sides, while in still others, the heater may be positioned such that it extends across a first pair of opposite side portions of the opening and not across a second pair of opposite side portions of the opening.

The terms 'upstream' and 'downstream' are used herein in view of the direction of an airflow in the system. Upstream and downstream ends of the system are defined with respect to the airflow when a user draws on the proximal or mouth end of the aerosol-generating smoking article, Air is drawn into the system at an upstream end, passes downstream through the system and exits the system at the proximal or downstream end. The terms 'proximal' and 'distal' as used herein refer to the position of an element with respect to its orientation to a consumer or away from a consumer. Thus, a proximal end of a mouthpiece of aerosol-generating system corresponds to the mouth end of the mouth piece. A distal opening of a cartridge housing corresponds to a position of an opening arranged in the cartridge housing facing away from a consumer, accordingly.

The heater used in smoking systems consistent with embodiments of the present disclosure may for example be a fluid permeable heating assembly comprising one or more electrically conductive heating elements. The one or more electrically conductive heating elements are dimensioned and arranged to generate heat when a current is applied to them. Fluid permeable heating assemblies are suitable for vaporizing liquids of different kind of cartridges. For example, as a liquid aerosol-forming substrate, a cartridge may contain a liquid or a liquid containing transport material such as for example a capillary material. Such a transport material and capillary material actively conveys liquid and is preferably oriented in the cartridge to convey liquid to the heating element. In embodiments, the one or more conductive heating elements are heat-producing filaments are arranged close to the liquid or to the liquid containing capillary material such that heat produced by a heating element vaporize the liquid. Preferably, the filaments and aerosol-forming substrate are arranged such that liquid may flow into interstices of the filament arrangement by capillary action. The filament arrangement may also be in physical contact with a capillary material.

In embodiments, a fluid permeable heating assembly comprises one or more heating elements through which a common plane passes, such that the heater has a substantially flat orientation. Such a heating element may for example be a flat coil embedded in a porous ceramic or a mesh heater, wherein a mesh or another filament arrangement is arranged over an opening in the heater. The fluid permeable heating assembly may, for example, comprise an electrically conductive mesh or coil pattern printed onto a heat resistance support piece. The support piece may for example be ceramic, polyether ether ketone (PEEK), or other thermally resistant ceramics and polymers that do not thermally decompose and release volatile elements at temperatures below 200 C and preferably at temperatures below 150 C.

The heater vaporizes liquid from a cartridge or cartridge housing comprising an aerosol-forming substrate. The aerosol-forming substrate is a substrate capable of releasing volatile compounds that can form an aerosol. The volatile compounds may be released by heating the aerosol-forming substrate. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material. The aerosol-forming substrate may comprise homogenised tobacco material. The aerosol-forming substrate may comprise at least one aerosol-former. An aerosol-former is any suitable known compound or mixture of compounds that, in use, facilitates formation of a dense and stable aerosol and that is substantially resistant to thermal degradation at the operating temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The aerosol-forming substrate may comprise other additives and ingredients, such as flavourants.

The aerosol forming substrate may be conveyed to the heating element(s) via a capillary material in contact with or adjacent to the heating element(s). The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid to the heating element. Alternatively, the capillary material may comprise sponge-like or foam-like material. The structure of the capillary material forms a plurality of small bores or tubes, through which the liquid can be transported by capillary action. The capillary material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid has physical properties, including but not limited to viscosity, surface tension, density, thermal conductivity, boiling point and vapour pressure, which allow the liquid to be transported through the capillary device by capillary action.

The capillary material may be in contact with electrically conductive filaments of the heater. The capillary material may extend into interstices between the filaments. The heating element may draw liquid aerosol-forming substrate into the interstices by capillary action. The capillary material may be in contact with the electrically conductive filaments over substantially the entire extent of an aperture in the heating element.

The heating element(s) may be provided in a heating assembly including support elements. The heating assembly may contain two or more different capillary materials, wherein a first capillary material, in contact with the heating element, has a higher thermal decomposition temperature and a second capillary material, in contact with the first capillary material but not in contact with the heating element has a lower thermal decomposition temperature. The first capillary material effectively acts as a spacer separating the heating element from the second capillary material so that the second capillary material is not exposed to temperatures above its thermal decomposition temperature. As used herein, 'thermal decomposition temperature' means the temperature at which a material begins to decompose and lose mass by generation of gaseous by products. The second capillary material may advantageously occupy a greater volume than the first capillary material and may hold more aerosol-forming substrate that the first capillary material. The second capillary material may have superior wicking performance to the first capillary material. The second capillary material may be a less expensive or have a higher filling capability than the first capillary material. The second capillary material may be polypropylene.

The flow route(s) may be selected to achieve a desired result, for example a predefined air volume passing through the one or more channels and impinging upon the heater surface(s). For example, a length or diameter of a channel may be varied, for example also to achieve a predefined resistance to draw (RTD). Flow route(s) are also selected according to a set-up of an aerosol generating smoking system and the arrangement and characteristics of the individual components of the smoking system. For example, aerosol may be generated at a proximal end or at a distal end of a cartridge housing containing the aerosol-forming substrate. Depending on the orientation of the cartridge in the aerosol-generating smoking system, the open end of the cartridge housing is arranged to face a mouthpiece or is arranged facing away from the mouthpiece. Accordingly, a heating element for heating the aerosol-forming substrate is arranged at a proximal or distal end of the housing. Preferably, liquid is vaporized at the open distal end of the mouthpiece and a heating element is arranged between cartridge and mouthpiece.

In some embodiments, one or more heating elements are arranged at an open proximal end of the cartridge housing, for example to cover the proximal end of the cartridge (top version). In such embodiments, the first flow route and first channel may be entirely arranged in a mouthpiece of the smoking system, a first air inlet is arranged in a side wall of the mouthpiece, and one or several outlets of the first channel are arranged in the proximal or mouth end of the mouthpiece. Optionally, additional flow routes and channels are defined in the mouthpiece. The first and any additional channels are arranged according to the location of the heating element(s) of the smoking system. In embodiments where For example, if a heating element is arranged at an open proximal end of the cartridge housing, for example to cover the proximal end of the cartridge (top version), the channel(s) may also be arranged entirely in a mouthpiece.

In alternative embodiments wherein the one or more heating elements are arranged at an open distal end of the cartridge housing, the flow route(s) routinely start at a further distal location in the smoking system, for example in the region of a distal end of the cartridge housing To this end, air inlet(s) and a first portion of each channel may be arranged in a main section of the smoking system to define a first channel portion in fluid communication with the corresponding channel portions defined in the mouthpiece. Ambient air is then directed into the system, passes the heating element at the distal end of the cartridge and entrains vapour generated by heating the aerosol-forming substrate in the cartridge. The aerosol containing air may then be guided along the cartridge between a cartridge housing and a main housing to the downstream end of the system, where it is mixed with ambient air from the first flow route (either before or upon reaching the downstream end).

A single channel may diverge into several channel portions downstream of the heating element(s), and several channel portions upstream of the heating element(s) may converge into a single channel before being brought into orthogonal impingement against a geometric center of the heater. In addition, a first channel may consist of several first partial channels and a second channel may consist of several second partial channels.

The flow routes may provide many variants to supply ambient air to the heating element and transport aerosol away from the heating element and to a downstream end of the system. For example, a radial supply of ambient air is preferably combined with and large central extraction. A central supply of ambient air is preferably combined with a radial distribution of the air over an entire heating element surface with a circumferential conveying of the aerosol containing air to the downstream end. In such embodiments, the flow routes are merged to direct ambient air to impinge onto the heating element, for example perpendicular to the heating element, preferably onto a center of the heating element.

Airflow directed perpendicularly to a center portion of heating element demonstrates improved aerosolization in terms of smaller particle sizes and higher amounts of total particulate matter present in the aerosol stream when compared to airflow that impinges the surface at an angle greater than 0 and less than 90 degrees. This may be due to a lower level of vortices created at the heater element and airflow interface, improved aerosol production by maximizing the whole of the heater (for example, portions outside of the center portion of the heater element contribute additional or higher amounts of aerosol), or due to a higher wicking effect based on a higher volume of air crossing the heating element.

A method for guiding an airflow in an electrically heated smoking system for generating aerosol comprises directing ambient air from outside the system perpendicularly against a heating element and conveying heated, vapor-containing air to promote supersaturation of vapor generated by heating of the liquid.

BRIEF DESCRIPTION OF THE DRAWINGS

The invention is further described with regard to embodiments, which are illustrated by means of the following drawings, wherein.

DETAILED DESCRIPTION

Figure 1:
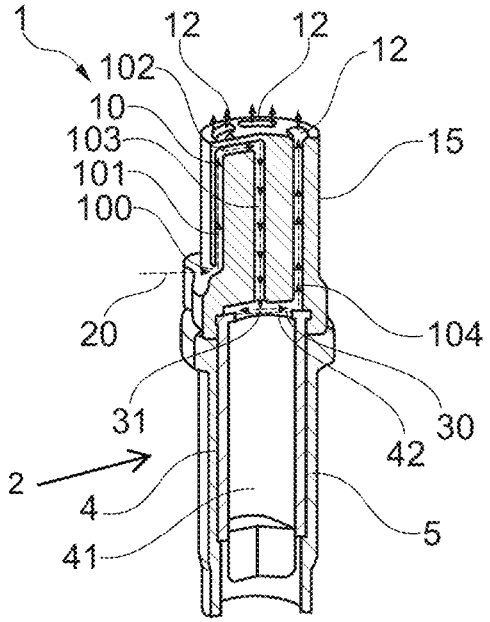
FIG. 1 shows an aerosol-generating system employing a flow of air according to embodiments consistent with the present disclosure.

In FIG. 1 a cartridge 2 and mouthpiece 1 embodiment for an aerosol generating smoking system is shown. An elongate main housing 5 accommodates a cartridge 2 with a tubular shaped container 4 containing an aerosol-forming substrate 41, for example a liquid containing capillary material. The container 4 has an open proximal end 42. A heater 30, is arranged to cover the open proximal end of the container 4. In some embodiments, the heater 30 is a fluid permeable heater having a substantially flat profile. In an embodiment, the heater 30 is a substantially flat mesh arrangement of electrically heated filaments. The filaments or other heating element(s) of heater 30 may or may not be in direct physical contact with the aerosol-forming substrate 41. A mouthpiece 1 having a substantially tubular shaped elongate body 15 is aligned with the main housing, the container 4 and the heater 30. The elongate body 15 has an open distal end facing the heater 30.

The embodiment shown in FIG. 1 comprises a first channel 10 which defines a first flow route in the mouthpiece 1. Incoming ambient air 20 enters the first flow route via inlet 100 and follows the flow path defined by first channel 10. This flow path brings the ambient air into impingement against the center of heater 30. Preferably, the impingement occurs at the geometric center of the heater and at angle at or close to ninety degrees (i.e., the flow is substantially orthogonal to a plane containing heated surface(s) of heater 30. The vaporized liquid produced by heater 30 is entrained as an aerosol by the air flow 20, and from there the air is delivered to outlets 12 at a proximal end or mouth end of the mouthpiece 1, to be inhaled when a consumer puffs. In some embodiments, a single channel as first channel 10 may be alone sufficient for drawing a desired amount of ambient air with each puff. In other embodiments, it may be desirable to include two or more inlets and associated channels. For example, a second channel (not shown) may be provided to draw in additional air such that the ambient air flows are combined before impinging upon heater 30.

In the embodiment of FIG. 1, inlet 100 into the first flow route is an opening or bore hole in the mouthpiece 1 located at a distal half of the elongate body 15 of the mouthpiece 1. The first flow route in an upstream second channel portion 101 runs in the elongate body parallel to the circumference of the elongate body to the proximal end of the mouthpiece. In a radially inwardly directing portion 102 of the first channel 10, the first airflow 20 is directed to the center of the elongate body and in a centrally arranged portion 103 of the first channel the first airflow 20 is directed to the heater 30 to impinge to the center 31 of the heater 30. The first airflow 20 passes over the heater 30 and spreads radially outwardly to several longitudinal end portions 104 of the first channel 10. The longitudinal end portions 104 are regularly arranged along the circumference within the elongate body.

In this embodiment the flow route and corresponding channel is arranged entirely within the mouthpiece 1 of the aerosol generating system. One or more additional flow routes defined, for example, by symmetrically arranged channels, may be defined in the mouthpiece such that the flows merge by the time the ambient air reaches the centrally arranged portion 103.

Figure 2:
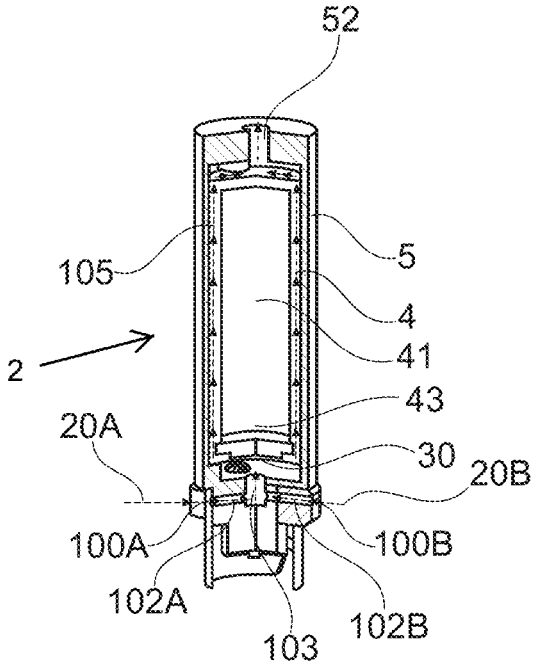
FIG. 2 shows an aerosol-generating system employing a flow of ambient air and vapor-entrained air according to other embodiments consistent with the present disclosure

In FIG. 2 an embodiment of a cartridge 2 with heater 30 arranged at the bottom of the cartridge covering an open distal end 43 of the container 4 is illustrated. In this embodiment, first inlet 100A is arranged in the main housing 5 and the ambient air 20A is directly led in a radially inwardly directing portion 102A of the first channel to the center of the main housing. In addition, a second inlet 100B is arranged in the main housing 5 and the ambient air 20B is directly led in a radially inwardly directing second channel 102B to the center of the main housing 5. The first and second channels merge to form a single flow within centrally arranged portion 103 of the first channel, and the merged air flow is directed to impinge perpendicularly onto the heater 30. The air then passes the heater 30, entrains aerosol caused by heating the liquid in the aerosol-forming substrate 41 through the heater 30. The aerosol containing air is led to the proximal end of the cartridge 2 after entering a ninety degree bend into one of several elongated, longitudinal portions 105 of first channel 10 arranged between and along cartridge 2 and an interior surface of main housing 5.

There, the aerosol containing airflow is guided to and out of a single centrally arranged opening 52 in the main housing 5. A mouthpiece (not shown) may be arranged adjacent to and aligned with the main housing. Preferably, the mouthpiece then also has a centrally arranged opening and end portion 104 of first channel 10 to receive the aerosol containing airflow and guide it to a single outlet opening 12 in the proximal end of the mouthpiece 1.

Figure 3A:
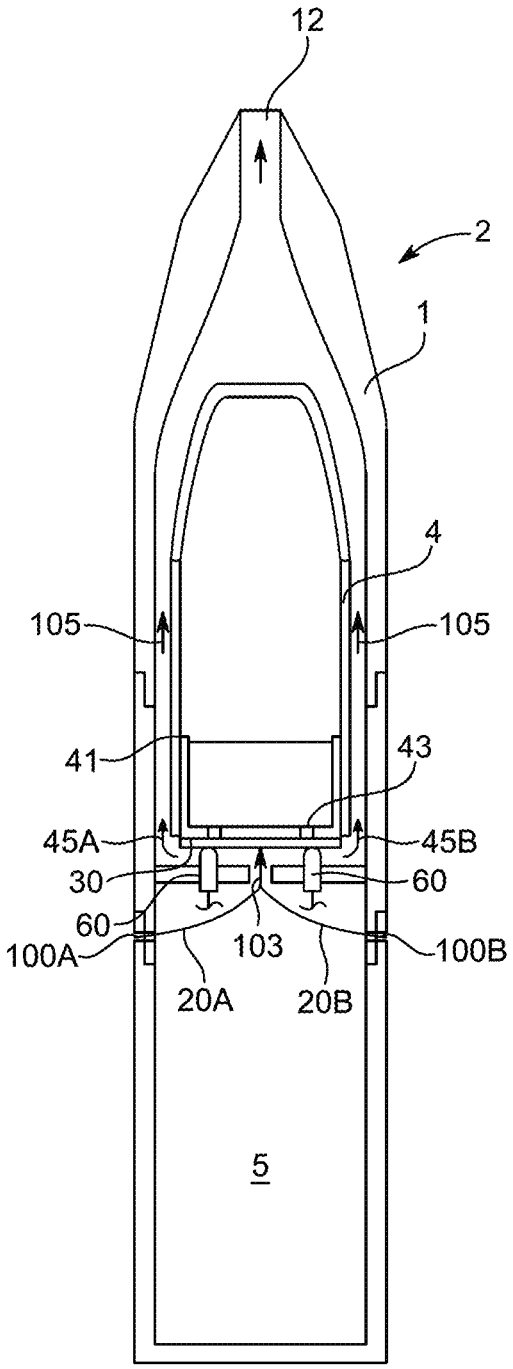
FIG. 3A shows the assembled form, in cross section, of an aerosol-generating system employing a flow of ambient air and vapor-entrained air according to another embodiment consistent with the present disclosure.
Figure 3B:
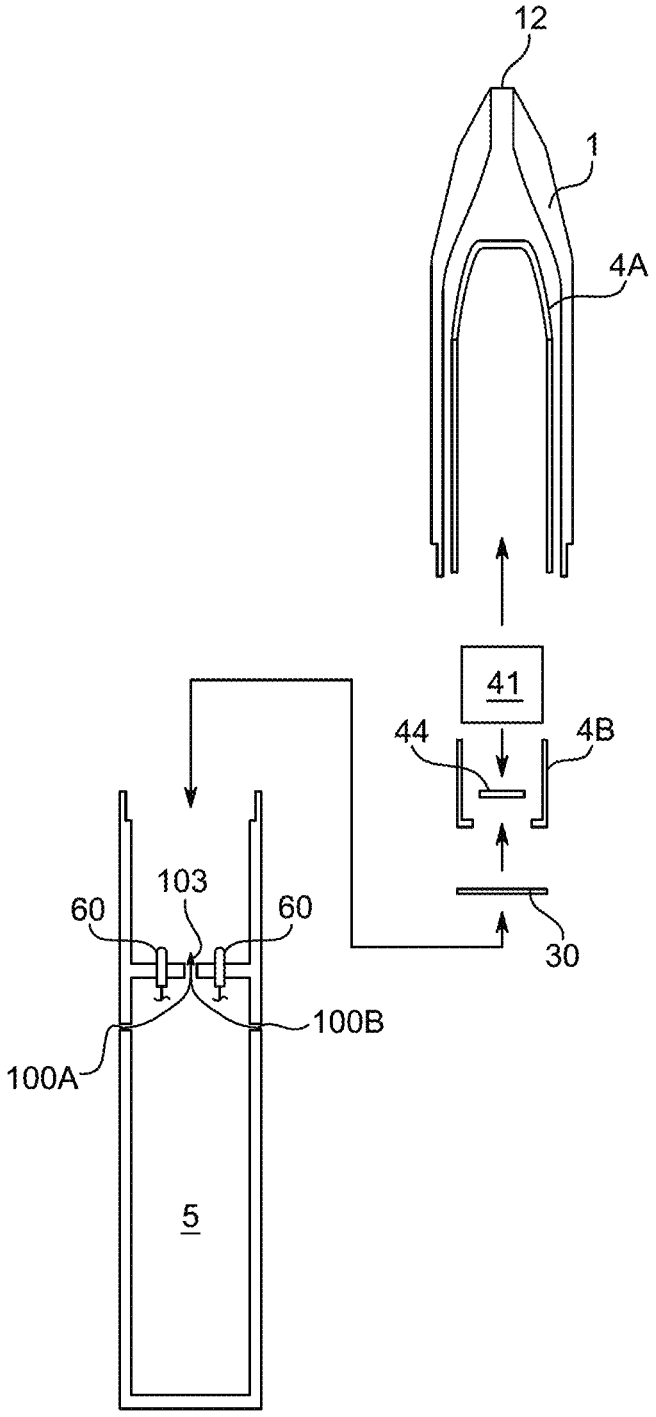
FIG. 3B shows a broken apart or unassembled form, in cross section, of the embodiment of FIG. 3A.

FIGS. 3A and 3B depict an additional embodiment of a system 8 that includes a cartridge 2 with heater 30 arranged at the bottom of the cartridge covering an open distal end 43 of the cartridge 2 is illustrated. In this embodiment, first inlet 100A is arranged in the main housing 5 and the ambient air 20A is directly led in a radially inwardly directing portion 102A of the first channel to the center of the main housing. In addition, a second inlet 100B is arranged in the main housing 5 and the ambient air 20B is directly led in a radially inwardly directing second channel 102B to the center of the main housing 5. The first and second channels merge to form a single flow within centrally arranged portion 103 of the first channel, and the merged air flow is directed to impinge perpendicularly onto the heater 30. Conductive contacts 60, which are electrically coupled to a power source (not shown) located within main housing 5 are in electrical contact with corresponding contacts of heater 30, and supply the heater with the electrical current.

The air arriving via first channel portion 103 passes the heater 30 and entrains vapor and condensed droplets caused by heating the liquid in the aerosol-forming substrate 41 through the heater 30. The aerosol so generated is led to the proximal end of the cartridge 2 after entering a ninety degree bend 45*a*, 45*b* into one of several elongate longitudinal portions 105 of first channel 10 arranged between and along cartridge 2. Thereafter, the aerosol guided to and out of a centrally arranged outlet opening 12 in the proximal end of the mouthpiece 1.

FIG. 3B is broken apart to show the system 8 in greater detail. It can be seen that the cartridge 2, comprising sections 4A and 4B, receives the aerosol-forming substrate 41, such as a liquid containing high retention material or high release material (HRM), which serves as a liquid reservoir and to direct liquid towards the heater 30 for evaporation at the heater. A capillary disc 44, for example a fiber disc, is arranged between HRM and heater 30. The material of the capillary disc 44 may be more heat resistant than the HRM due to its closeness to the heater 30 in order to provide thermal isolation and protect the HRM itself from decomposition. The capillary disc 44 is kept wet with the aerosol-forming liquid of the HRM to secure provision of liquid for vaporization if the heater is activated.

Figure 4:
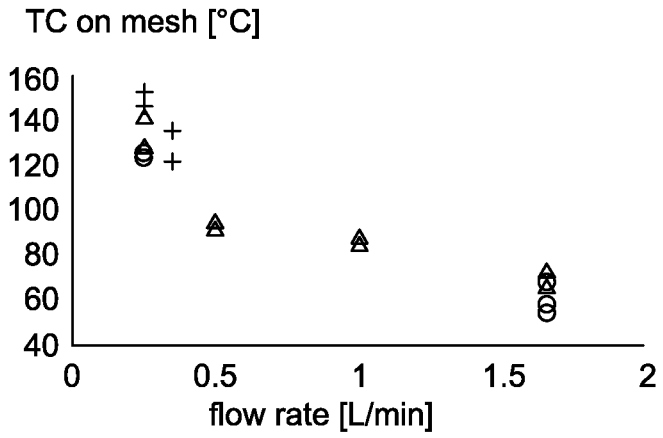
FIG. 4 shows the cooling effect of different airflows on different heating element.

The data shown in FIG. 4 demonstrate the relationship between air flow rate and cooling of the mesh heater. Cooling rates were measured using different mesh heaters: Reking (45 micrometers/180 per inch), Haver (25 micrometers/200 per inch) and 3 strips Warrington (25 micrometers/250 per inch). Measurement data for the Reking heater are indicated by crosses, measurement data for the Haver heater are indicated by circles and measurement data for the 3 strips Warrington heater are indicated by triangles. All heaters were operated at three Watt. Temperature was measured with a thermocouple coupled to the heaters. Increasing the flow rate as indicated on the x-axis in liter per minute [L/min] results in a lower measured temperature on the mesh heater. Typical sizes of airflows in aerosol-generating systems can be approximated by standard smoking regimes, for example the Health Canada smoking regime, which leads to significant cooling of the heater. Exemplary smoking regimes such as Health Canada draw 55 ml of a mix of air and vapour over 2 seconds. An alternative regime is 55 ml over 3 seconds. Neither exemplary smoking regime mimics behaviour precisely but instead act as a proxy to what an average user would draw. To compensate for the higher cooling rate associated with a high rate of air flow and perpendicular impingement of air onto the surface(s) of heater 30, it may be necessary to supply increases levels of current to the heating element(s) thereof.

Figure 5:
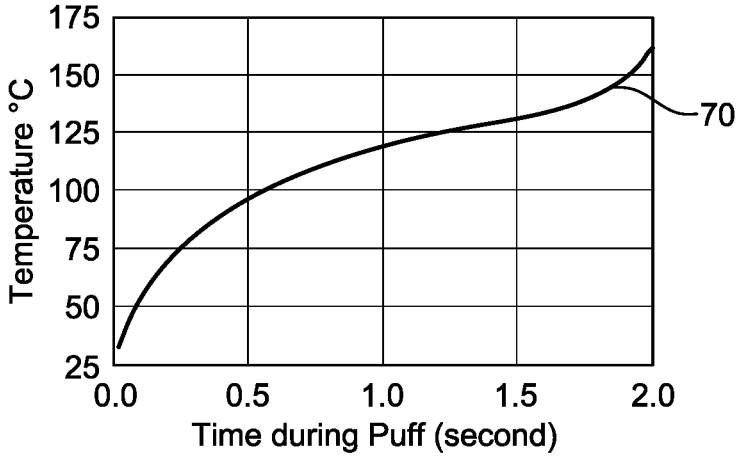
FIG. 5 shows a temperature curve based on an exemplary flow impingement pattern and substantially planar arrangement of powered heating filaments forming a mesh heater.

In the graph of FIG. 5, average temperatures at the heater versus time during one puff is shown. Curve 60 represents reference temperature data for the heater, where the total airflow is directed to the heater. For the reference data the heater had been heated with Watt.

Figure 6:
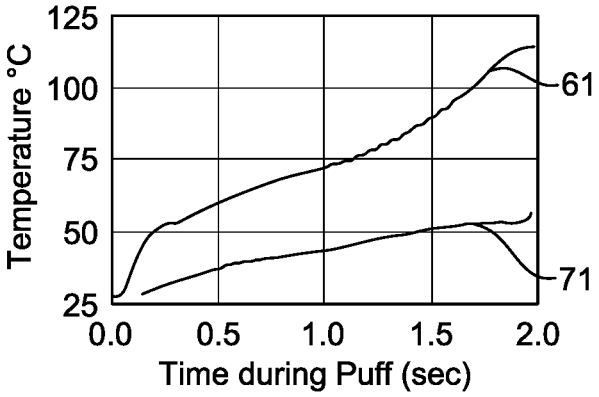
FIG. 6 shows temperature curves at the outlet of the mouthpiece.

FIG. 6 shows the effect, on the temperature of the aerosol carrying airflow at the outlet of the mouthpiece during one puff, of directing the vapor-entrained airflow along the portion of the cartridge 2 containing the aerosol-forming substrate 41. The data refers to embodiments where ambient airflow is brought in through outlets in a main housing, perpendicularly impinged against the surface of a substantially planar heater arranged in a transverse plane across a cartridge opening distal to the inhalation end of the mouthpiece, and bent around a downstream flow channel to carry the airflow toward the inhalation end of the mouthpiece, as shown in FIGS. 2 and 3A. Temperature curve 61 represents outlet air temperatures for a heater powered with 5 Watt with the total airflow impinging on the heater and exiting according to the arrangement shown in FIG. 1. Temperature curve 71 represents outlet air temperatures for a heater also powered with 5 Watts, but where the airflow is passed in close proximity to the liquid storage portion to promote cooling as shown in FIGS. 2 and 3A. There are significant lower temperatures of the aerosol carrying airflow at the proximal outlet of the main housing 5 and mouthpiece 1 in the arrangements of FIGS. 2 and 3A due to the transfer of heat to the zone of the cartridge housing proximate the liquid storage portion. Typically 'fresh' air mixed into the aerosol carrying airflow is at room temperature.

Figure 7:
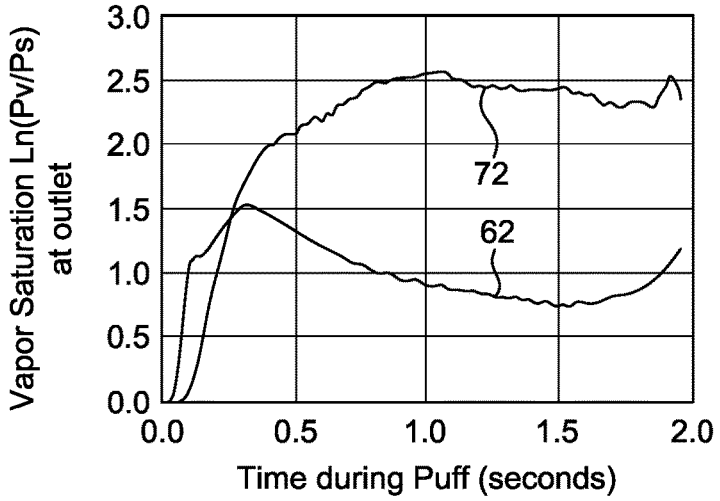
FIG. 7 shows average vapor saturation curves at the outlet of the mouthpiece.
Figure 8:
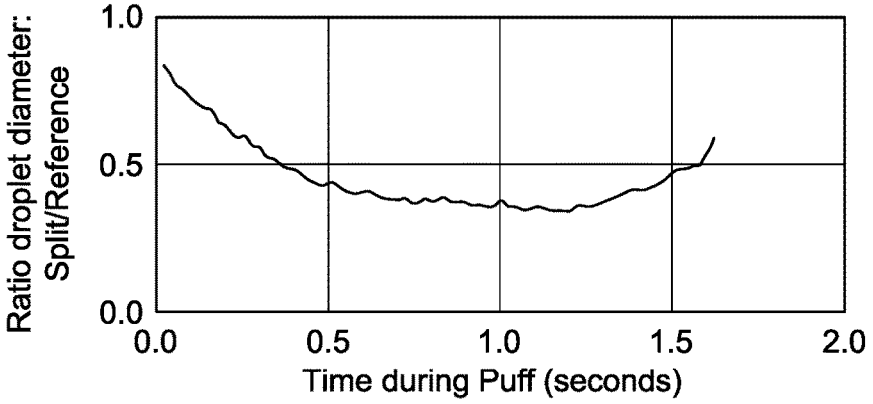
FIG. 8 shows the ratio of droplet diameters at the outlet of the mouthpiece for the air airflow geometries of FIGS. 1 and 2 with the same heater configuration and applied power.

Significant difference may also be seen in the ratio of vapour pressure to the saturation pressure (Pvapor/Psaturation) of a glycerol solution at the outlet of the mouthpiece during one puff. This ratio is shown in FIG. 7. Curve 72 refers to pressure data at the outlet for the heater powered with 5 Watt, with the total airflow directed to the heater according to the arrangements of FIGS. 2 and 3A. Curve 62 refers to pressure data at the outlet for the heater powered with 5 Watt with the total airflow impinging on the heater according to the arrangement of FIG. 1. This represents a larger degree of super saturation of the glycerol solution, which favours aerosolization with smaller droplets. Simulation clearly predicts smaller droplet sizes for the cooler vapour of the split airflow embodiment compared to vapour of non-split or total airflow embodiments. These simulation data 67 are shown in FIG. 8 for one puff at the outlet of the mouthpiece. Y-Axis represents the ratio of droplet diameters for split airflow to total airflow systems. The ratios are calculated and shown as d_split/d_ref=T*Ln(S) ref/T*Ln(S) split versus time (in seconds) during one puff on the aerosol-generating system where T is the temperature expressed in degrees Kelvin and S is the saturation ratio which is a function of Pv and $$P_{\infty}(T).$$

Figure 9A:
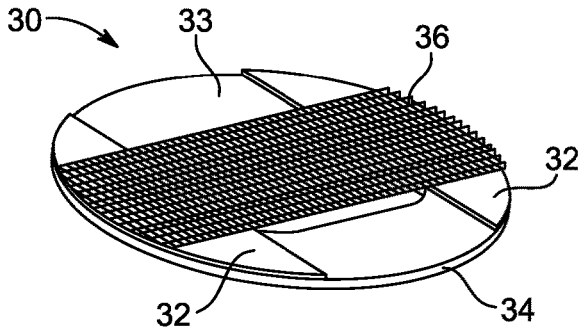
FIG. 9*a*, 9*b* show heating elements as may be used in the smoking system according to the invention.

FIG. 9*a* is an illustration of a first heater 30. The heater 30 is a fluid permeable assembly of heating elements and comprises a mesh 36 formed from 304 L stainless steel, with a mesh size of about 400 Mesh US (about 400 filaments per inch). The filaments have a diameter of around 16 micrometer. The mesh is connected to electrical contacts 32 that are separated from each other by a gap 33 and are formed from a copper or tin foil having a thickness of around 30 micrometer. The electrical contacts 32 are provided on a polyimide substrate 34 having a thickness of about 120 micrometer. The filaments forming the mesh define interstices between the filaments. The interstices in this example have a width of around 37 micrometer, although larger or smaller interstices may be used. Using a mesh of these approximate dimensions allows a meniscus of aerosol-forming substrate to be formed in the interstices, and for the mesh of the heating element to draw aerosol-forming substrate by capillary action. The open area of the mesh, that is, the ratio of the area of interstices to the total area of the mesh is advantageously between 25 percent and 56 percent. The total resistance of the heating element is around 1 Ohm. The mesh provides the vast majority of this resistance so that the majority of the heat is produced by the mesh. In this example the mesh has an electrical resistance more than 100 times higher than the electrical contacts 32.

The substrate 34 is electrically insulating and, in this example, is formed from a polyimide sheet having a thickness of about 120 micrometer. The substrate is circular and has a diameter of 8 millimeter. The mesh is rectangular and has side lengths of 5 millimeter and 2 millimeter. These dimensions allow for a complete system having a size and shape similar to a convention cigarette or cigar to be made. Another example of dimensions that have been found to be effective is a circular substrate of diameter 5 millimeter and a rectangular mesh of 1 millimeter times 4 millimeter.

Figure 9B:
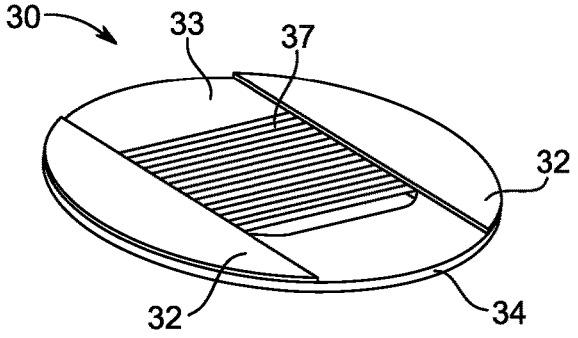

FIG. 9*b* is an illustration of an alternative heater assembly. In the heating element of FIG. 8*b*, the electrically conductive, heat-producing filaments 37 are bonded directly to substrate 34 and the contacts 32 are then bonded onto the filaments. The contacts 32 are separated from each other by insulating gap 33 as before, and are formed from copper foil of a thickness of around 30 micrometer. The same arrangement of substrate filaments and contacts can be used for a mesh type heater as shown in FIG. 8*a*. Having the contacts as an outermost layer can be beneficial for providing reliable electrical contact with a power supply.

Returning to FIGS. 1 to 3B, capillary material is advantageously oriented in the housing 4 to convey liquid to the heater 30. When the cartridge is assembled, the heater filaments 36, 37, 38 may be in contact with the capillary material and the aerosol-forming substrate 41 can be conveyed directly to the mesh heater.

In use the heating elements operate by resistive heating. Current is passed through the filaments 36,37,38, under the control of control electronics (not shown), to heat the filaments to within a desired temperature range. The mesh or array of filaments has a significantly higher electrical resistance than the electrical contacts 32,35 and electrical connectors (not shown) so that the high temperatures are localised to the filaments. The system may be configured to generate heat by providing electrical current to the heating element in response to a user puff or may be configured to generate heat continuously while the device is in an "on" state.

Different materials for the filaments may be suitable for different systems. For example, in a continuously heated system, graphite filaments are suitable as they have a relatively low specific heat capacity and are compatible with low current heating. In a puff actuated system, in which heat is generated in short bursts using high current pulses, stainless steel filaments, having a high specific heat capacity may be more suitable.

In the above cartridge systems as described in FIG. 1 to FIG. 3B, the container 4 may also be a separate cartridge container in addition to the cartridge 2 as described for example in FIG. 1. Especially, a liquid containing cartridge is a pre-manufactured product, which may be inserted into a cartridge 2 provided in the aerosol generating system for receiving the pre-manufactured cartridge.

The invention claimed is:

1. An aerosol-generating system comprising:

a cartridge including a liquid storage portion comprising a container for holding a liquid aerosol-generating substrate and defining an opening;

a heater assembly, wherein the heater assembly comprises at least one electrically operated heating element, and wherein the heating element extends across the opening along a transverse plane of a central axis of the opening;

a capillary material in contact with the heating element configured for conveying the aerosol forming substrate to the heating element;

a first channel located in the cartridge and defining a first flow route, wherein a centrally arranged portion of the first channel is arranged with respect to the transverse plane such that the at least the centrally arranged portion of the first channel directs air originating from outside the system to impinge against and across a surface portion of the at least one heating element, wherein the centrally arranged portion of the first channel and the liquid storage portion are located on opposite sides of the heating element;

wherein the air is brought by the first flow route into orthogonal impingement against a geometric center of a surface of the heating element;

wherein the system comprises a main unit and the cartridge that is removably coupled to the main unit, wherein the liquid storage portion and heater assembly are provided in the cartridge and the main unit comprises a power supply; and wherein the cartridge further defines at least one inlet for drawing ambient air from outside the system and at least a first portion of the first channel corresponding to a flow path relative to the heater assembly.

2. The aerosol-generating system according to claim 1, wherein the portion of the first channel which directs air into impingement against and across the surface portion of the at least one heating element is orthogonal to the transverse plane.

3. The aerosol-generating system according to claim 1, wherein the capillary material is aligned with the opening, and wherein the liquid aerosol-generating substrate is drawn via the capillary material to the at least one electrically operated heating element.

4. The aerosol-generating system according to claim 1, wherein the cartridge defines a second portion of the first channel in fluid communication with the first portion.

5. The aerosol-generating system according to claim 1, further comprising a mouthpiece, wherein the opening of the container faces away from the mouthpiece.

6. The aerosol-generating system according to claim 1, wherein the heater assembly is disposed at a distal end of the container.

7. The aerosol-generating system according to claim 1, wherein a portion of the first channel is dimensioned and arranged to transport air away from the heater assembly along a bend.

8. The aerosol-generating system according to claim 1, wherein the capillary material comprises a ceramic material.

9. The aerosol-generating system according to claim 1, wherein the heater assembly is a fluid permeable heater assembly comprising one or more electrically conductive heating elements.

10. The aerosol-generating system according to claim 9, wherein the fluid permeable heater assembly comprises one or more heating elements through which a common plane passes such that the heater assembly has a substantially flat orientation.

11. The aerosol-generating system according to claim 9, wherein the fluid permeable heater assembly comprises an electrically conductive filament pattern printed onto a heat resistance support piece.

12. The aerosol-generating system according to claim 11, wherein the heat resistance support piece is ceramic.

13. The aerosol-generating system according to claim 1, wherein the first channel defines an airflow pathway that extends in a direction orthogonal to the plane and to a surface of the capillary material.

14. The aerosol-generating system according to claim 1, wherein the portion of the first channel is arranged with respect to the transverse plane such that the at least a portion of the first channel directs air originating from outside the system to impinge against a center portion of the at least one heating element and across a surface portion of the at least one heating element to provide an airflow over the heating element in a radially outward direction.

15. The aerosol-generating system according to claim 1, wherein the first channel consists of several first partial channels.

16. The aerosol-generating system according to claim 1, wherein the heating element partially covers the opening.

17. The aerosol-generating system according to claim 1, wherein the heating element completely covers the opening.

18. The aerosol-generating system according to claim 1, wherein the heating element is positioned within the opening of the liquid storage portion.

19. The aerosol-generating system according to claim 1, wherein the centrally arranged portion of the first channel is coaxial with the central axis of the opening and a transverse portion of the first channel, which is located upstream from the centrally arranged portion, extends in the transverse plane.

20. A method for guiding an airflow in an electrically operated aerosol-generating system, the method comprising:

supplying a liquid aerosol-generating substrate;

supplying a capillary material in contact with a heating element configured to convey the aerosol forming substrate to the heating element;

directing, via a first channel located within the cartridge and defining a first flow route, air originating from outside the system into orthogonal impingement against a geometric center of a surface of the heating element and against and along the heating element aligned with an opening in a container containing the aerosol generating substrate, wherein a centrally arranged portion of the first channel and the liquid storage portion are located on opposite sides of the heating element; and conveying a generated aerosol to the downstream end of the system, wherein the system comprises a main unit and a cartridge that is removably coupled to the main unit, wherein the liquid storage portion and a heater assembly comprising the heating element are provided in the cartridge and the main unit comprises a power supply, and wherein the cartridge further defines at least one inlet for drawing ambient air from outside the system and at least a first portion of the first channel corresponding to a flow path relative to the heater assembly.

* * * * *